US011187393B1

(12) United States Patent
Potter

(10) Patent No.: US 11,187,393 B1
(45) Date of Patent: Nov. 30, 2021

(54) LIGHT SYSTEM WITH CUT-OFF

(71) Applicant: Valeo Vision, Bobigny (FR)

(72) Inventor: Brant Potter, Seymour, IN (US)

(73) Assignee: Valeo Vision, Bobigny (FR)

( * ) Notice: Subject to any disclaimer, the term of this patent is extended or adjusted under 35 U.S.C. 154(b) by 0 days.

(21) Appl. No.: 17/137,483

(22) Filed: Dec. 30, 2020

(51) Int. Cl.
*F21S 41/33* (2018.01)
*F21Y 105/10* (2016.01)

(52) U.S. Cl.
CPC ..... *F21S 41/337* (2018.01); *F21S 41/336* (2018.01); *F21Y 2105/10* (2016.08)

(58) Field of Classification Search
CPC ..... F21S 41/336–337; F21S 7/048
See application file for complete search history.

(56) References Cited

U.S. PATENT DOCUMENTS 4,704,661 A * 11/1987 Kosmatka ..... F21S 41/336 362/518
5,086,376 A * 2/1992 Blusseau ..... F21S 41/335 362/518
6,000,816 A 12/1999 Serizawa et al.
6,773,150 B2 * 8/2004 Giordani ..... F21S 48/1364 362/348
7,204,627 B2 4/2007 Ishida
7,461,953 B2 12/2008 Yamamoto
7,866,863 B2 1/2011 Tanaka
8,523,414 B2 9/2013 Uchida
8,616,741 B2 * 12/2013 Ookubo ..... F21S 41/148 362/507
8,845,161 B2 * 9/2014 DiPenti ..... F21S 41/192 362/545
9,410,671 B2 8/2016 Lee et al.
9,638,385 B2 5/2017 Shin et al.
10,156,333 B2 * 12/2018 Shon ..... F21S 41/336
10,578,267 B2 * 3/2020 Bowles ..... F21S 41/148
2003/0031020 A1 * 2/2003 Komatsu ..... B60Q 1/12 362/465
2005/0141233 A1 * 6/2005 Matsumoto ..... F21S 41/334 362/517
2008/0225544 A1 * 9/2008 Fujiwara ..... F21S 41/29 362/538
2011/0149584 A1 * 6/2011 Stade ..... F21S 41/675 362/512
2015/0267886 A1 * 9/2015 Cabanne ..... F21S 41/148 362/516
2018/0058653 A1 * 3/2018 Alisafaee ..... F21S 41/151
2019/0383472 A1 * 12/2019 Mertens ..... F21V 7/048
2021/0041083 A1 * 2/2021 Wakafuji ..... F21V 7/0025

* cited by examiner

*Primary Examiner* — Keith G. Delahoussaye
(74) *Attorney, Agent, or Firm* — Young Basile Hanlon & MacFarlane, P.C.

(57) ABSTRACT

A light system comprising: (a) a plurality of light sources; (b) a plurality of reflectors that are each aligned with and reflect one or more of the plurality of light sources in a first direction away from a vehicle that houses the light system, wherein at least one of the plurality of reflectors comprises: (i) a plurality of reflector facets; (ii) a vertical centerline that extends through a central reflector facet; and (iii) an equal number of the plurality of reflector facets in a first region on a first side of the vertical centerline and second region on a second side of the vertical centerline; wherein the second region has a width from the centerline that is less than a width of the first region from the centerline.

20 Claims, 15 Drawing Sheets

LIGHT SYSTEM WITH CUT-OFF

FIELD

The present teachings relate to a light system including a precise cut-off and more specifically an accurate cut-off when the light system has the low beams activated.

BACKGROUND

Various measurement techniques have been used to monitor light and light patters of vehicle lighting systems. These measurement techniques grade the lights based upon a light pattern formed by the lights, and one such feature graded by these measurement techniques is a cut-off of the lights. One such cut-off occurs so that light does not glare or blind oncoming drivers. Since headlights in vehicles typically are static in position and once aimed maintain the aim a light that can precisely provide light will continue to accurately provide light for an extended duration.

Examples of light systems may be disclosed in U.S. Pat. Nos. 6,000,816; 7,866,863; 8,523,414; and 9,410,671 all of which are expressly incorporated herein by reference for all purposes. Thus, there is a need for a light system where the light extending from a vehicle has a vertical cut-off that is substantially planar. There is a need for a light system that provides light to a region with a cut-off that prevents light from extending into eyes of an oncoming driver. It would be desirable to have a light system where the lights extending from a vehicle have a sharp edge that is linear.

SUMMARY

The present teachings provide: a light system comprising: (a) a plurality of light sources; (b) a plurality of reflectors that are each aligned with and reflect one or more of the plurality of light sources in a first direction away from a vehicle that houses the light system, wherein at least one of the plurality of reflectors comprises: (i) a plurality of reflector facets; (ii) a vertical dividing line that extends through a central reflector facet; and (iii) an equal number of the plurality of reflector facets in a first region on a first side of the vertical dividing line and second region on a second side of the vertical dividing line; wherein the second region has a width from the dividing line that is less than a width of the first region from the dividing line.

The present teachings provide: a light system comprising: (a) a plurality of light sources; (b) a plurality of reflectors that are each aligned with and reflect light from one or more of the plurality of light sources in a first direction away from a vehicle that houses the light system, wherein at least one of the plurality of reflectors comprises: (i) a plurality of reflector facets; (ii) a vertical dividing line that extends through the at least one of the plurality of reflectors; (iii) a first region extending from a first side of the vertical dividing line to a first edge; and (iv) a second region extending from a second side of the vertical dividing line to a second edge that is located opposite the first edge; and wherein the second region has a width is less than a width of the first region.

The present teachings provide a light system where the light extending from a vehicle has a vertical cut-off that is substantially planar. The present teachings provide a light system that provides light to a region with a cut-off that prevents light from extending into eyes of an oncoming driver. The present teachings provide a light system where the lights extending from a vehicle have a sharp edge that is linear.

DETAILED DESCRIPTION

Figure 1:
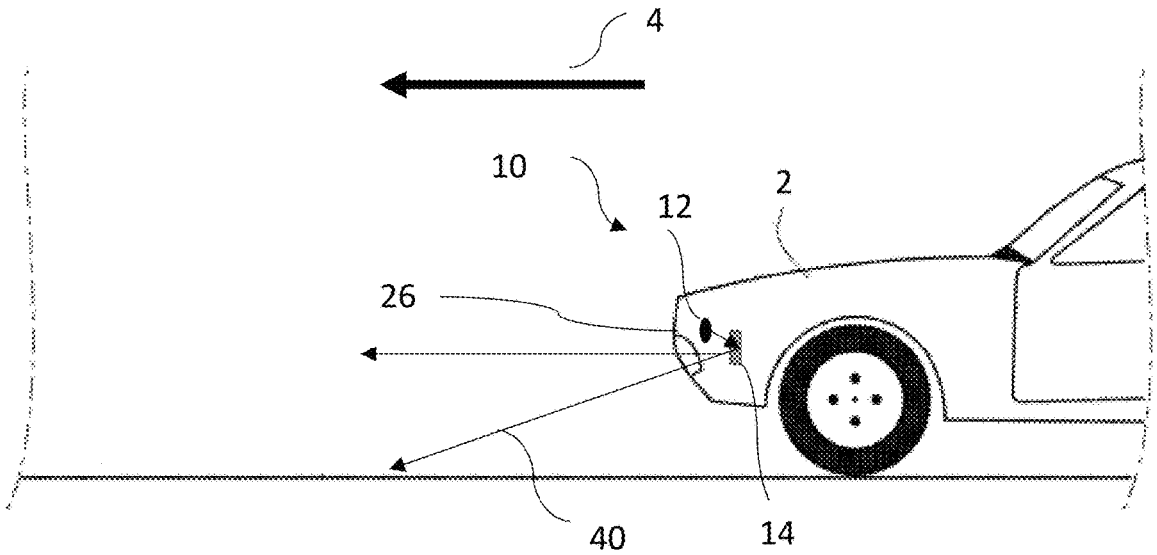
FIG. 1 is a top view of a vehicle including the light system.

The explanations and illustrations presented herein are intended to acquaint others skilled in the art with the invention, its principles, and its practical application. Those skilled in the art may adapt and apply the invention in its numerous forms, as may be best suited to the requirements of a particular use. Accordingly, the specific embodiments of the present invention as set forth are not intended as being exhaustive or limiting of the teachings. The scope of the teachings should, therefore, be determined not with reference to the above description, but should instead be determined with reference to the appended claims, along with the full scope of equivalents to which such claims are entitled. The disclosures of all articles and references, including patent applications and publications, are incorporated by reference for all purposes. Other combinations are also possible as will be gleaned from the following claims, which are also hereby incorporated by reference into this written description.

The present teachings relate to a light system. The light system is located with a vehicle. Preferably, the light system is part of a car, motorcycle, bus, truck, semi-truck, SUV, XUV, four-wheeler, dirt bike, boat, commercial vehicle, construction vehicle, farm equipment, plane, helicopter, or a combination thereof. The light system may project in a forward direction, rear direction, side direction, or a combination thereof. Preferably, the light system projects a light from an external surface of the vehicle to a location in front of the vehicle or in a direction of motion of the vehicle (e.g., in front of the vehicle or behind the vehicle). The light system may be integrated into a front end, a rear end, or both of a car. The light system may project light out of the vehicle. The light source may include lights and optical elements, reflectors, lenses, a housing, or a combination thereof.

The light source may have one or more lenses. The lenses function to protect the light system. The lenses function to allow light to pass through, refract the light, spread the light, or a combination thereof. The lenses may be made of a transparent material, a colored material, or both. The lenses may change a color of the light so that the light is projected in a specific wave length. The lenses may be made of polycarbonate. The lenses may prevent the light sources, the reflectors, or both from being contaminated with dirt, debris, fluids, or a combination thereof. The lenses may create a seal with a housing so that the light sources and reflectors are sealed therein.

The housings function to affix the light system to a location of interest (e.g., within a vehicle), house the reflectors, house the light sources, or a combination thereof. The housing may create an anchor for other parts of the light system to connect so that all of the components are aimed relative to one another. For example, the reflectors and light sources may be affixed to or within the housing so that the light source is aimed to a predetermined location of the reflector and the reflector may be affixed to or within the housing that the light from the light source is redirected (reflected) to a predetermined location. The housing may protect the light sources and the reflectors so that alignment of the components is not compromised or changed during use. The housing may house and aim the light sources so that light may be formed and projected outward away from a vehicle.

The lights of the light system may be created by one or more light sources or a plurality of light sources. The light system may include one or more light sources, two or more light sources, three or more light sources, four or more light sources, ten or less light sources, or six or less light sources. The one or more light sources function to produce light that illuminates a region. The light sources may be a device or plurality of devices that create light and the light extends outward from the light source and preferably away from a vehicle. The light source may produce a high beam, a low beam, or both. The light source may be aimed to project light in near field or far field. The light source may be any type of lighting device or light that produces light such as an incandescent bulb, fluorescent light, compact fluorescent lamp, halogen lamp, light emitting diode (LED), high intensity discharge lamps (HID); halogen lights, xenon lights, or a combination thereof. The light source may be a single lamp or bulb. Preferably, the light source includes a plurality of lamps, bulbs, diodes, or a combination thereof. The light source may be an array. The light source may include two or more, 5 or more, 10 or more, 20 or more, or even 50 or more devices that produce light and combine together to form the light source. Each light source may include 500 or less, 300 or less, or 200 or less devices that produce light. For example, if the light source is a 10×10 array of light devices some of the 100 devices may be selectively turned on and off, dimmed, brightened, or a combination thereof to create patterns, images, words, text, numbers, shapes, or a combination thereof. The light source may be a single light. The light source may be a plurality of lights. The light source may be static. The light source may be free of movement. The light source may be fixed. The light source may be fixed and the light from the light source may be moved, bent, directed, or a combination thereof by optical elements, lenses, reflectors, or a combination thereof. The light from the light source may be moved or aimed from near field to far field or vice versa. Each device of the light source may be turned on an off. The color, intensity, shape, or a combination thereof of each device of the light source may be controlled or adjusted. The light source may direct light to a driving surface. For example, a center of the light may be located on the driving surface. The light source may be indirectly directed to a driving surface. For example, the light source may be directed to a reflector and the reflector redirects the light in a direction of motion. The light source and the reflector may be located a distance apart (e.g., focal length). The distance between the light source and the reflector may be adjust cut-off. The distance may be varied depending on a shape and configuration of the reflector. The distance may be about 5 mm or more, about 10 mm or more, or about 15 mm or more (e.g., about 18 mm). The distance may be about 50 mm or less, about 40 mm or less, about 30 mm or less, or about 20 mm or less. Increasing the distance may make the lighted region smaller. Decreasing the distance may make the lighted region larger. The light source may direct light above a driving surface (e.g., some light may contact and illuminate the driving surface by a center of the light may be located above the driving surface). The light source may be directed substantially parallel to the light surface. For example, a center of the light, an axis of the light, or both may extend parallel to the driving surface. The light source may extend along an axis or may be directed away from the axis. If there are a plurality of light sources each light source may be associated with one collimator or reflector. Each collimator or reflector may direct the light outward to a predetermined location in a predetermined location. If there are a plurality of collimators or reflectors, then each may have an associated light source. One light source may be directed at one or more reflectors, two or more reflectors, three or more reflectors, four or more reflectors, or six or less reflectors. Two or more light sources may be directed at one reflector. Preferably, if there are four reflectors then there will be four light sources.

The one or more reflectors or a plurality of reflectors function to redirect light to a location of interest so that the location of interest is illuminated. The reflectors may spread the light in a region of interest. The reflectors may blend light. The reflectors may overlap light from another reflector. The reflectors may form one or more edges or cut-offs. Each reflector may create a pattern of light. Each reflector may work in conjunction with one or more adjacent reflectors. Each light system may include one or more reflectors, two or more reflectors, three or more reflectors, or four or more reflectors. Each light system may include ten or less, eight or less, six or less, or five or less reflectors. All of the reflectors may be identical. All of the reflectors may be different. Some of the reflectors may be the same and some may be different. The reflectors may have a geometric shape. The reflectors may be generally square, rectangular, a parallelogram, rhombus, trapezium, symmetrical, vertically symmetrical, horizontally symmetrical, or a combination thereof. The reflectors may have two vertical side edges that are generally parallel or parallel. The reflectors may have two horizontal edges that are generally parallel or parallel. The reflectors may be flat. The reflectors may be curved. The reflectors may have a concave portion. The reflectors may have a generally "U" shape, a generally "C" shape, generally both a "U" shape and a "C" shape, or a combination thereof. The surface of the reflectors may be a smooth curved shape.

The surface may have a bumpy surface, a wavy surface, or both. The reflectors may have a first side that is higher than a second side of an adjacent reflector and a second side that is lower than a second side of the adjacent reflector. For example, when traveling along a line a first side (or edge that determines a width or height of a reflector) of a first reflector may have a height relative to the line and a second side of the first reflector may have a height that is less than the first side, and a first side of a second reflector may have a height relative to the line that is greater than the second side of the first reflector but less than the first side of the first reflector and the second reflector may have a second side that is less than all three of the other sides. In another example, a top of the reflectors may be stepped so that each reflector is located subsequently lower than an adjacent reflector. Thus, the reflectors may be stepped relative to one another. The reflectors may be a single reflector facet. Preferably, the reflectors are a plurality of reflector facets.

The reflector facets or a plurality of reflector facets function to redirect light (e.g., reflect light) to a predetermined location in a predetermined pattern. The reflector facets may be planar to one another. Some of the reflector facets may be planar to some other reflector facets. All of the reflector facets may extend in a different reflector plane than all of the other reflector facets in a reflector. The reflector facets may create a generally smooth curvature. The reflector facets may be located side by side. The reflector facets may be located one on top of another. The reflector facets may have different shapes and sizes. A height of the reflector facets may all be the same. A height of the reflector facets in a row of reflector facets may be the same. A height of the reflector facets from row to row may vary. One row of reflector facets may have a first height and a second row of reflector facets may have a second height. The height of the rows may vary by about 5% or more, about 10% or more, or about 15% or more. The right of the rows may vary by about 50% or less, about 40% or less, about 30% or less, or about 20% or less. The reflector facets may all be generally a same shape and size. Some of the reflector facets may be a same size, a same shape, have a same height, have a same width, have a different height, have a different width, have a different size, have a different shape, or a combination thereof. Some or all of the reflector facets in a first region, a second region, or both are equal. Some or all of the reflector facets in a first region, a second region, or both are different. The reflector facets may have an equal number or an odd number in the first region and the second region, an equal number on a first side of a dividing line and a second side of a dividing line, on a first side of a vertical dividing line and a second side of the vertical dividing line, or a combination thereof. The reflector facets may vary as the reflector facets are located from a dividing line, a center reflector facet, or both. The reflector facets may have mirror symmetry relative to a dividing line of the reflector facet. The reflector facets may not have symmetry relative to a centerline of the reflector facet. For example, one side of the dividing line may have a first width, size, shape, or a combination thereof and a second side may have a second width, size, shape, or a combination thereof. The reflector facets may be located in rows and columns.

The rows, the columns, or both may have an odd number or an even number. The columns may have two or more, three or more, or four or more reflector facts. The columns may have eight or less, six or less, or five or less reflector facets. Preferably, there are two reflector facets stacked on one another in each column and separated by a horizontal dividing line. The rows may include two or more, three or more, four or more, five or more, six or more, seven or more, or even eight or more reflector facets. The rows may include twenty or less, fifteen or less, or ten or less reflector facets. The columns may be separated into a first region and a second region. The rows may be separated into an upper region and a lower region.

The upper region, the lower region, or both function to direct light to a first region, a second region, or both respectively or in a first direction, a second direction, or both respectively. The upper region, the lower region, or both may direct light in a generally upward direction or in a straight direction relative to a road surface. The upper region may direct light downward relative to a road surface or towards a road surface. The upper region may be smaller than a lower region. The upper region may include a same number of reflector facets as a lower region. The upper region may include a different number or reflector facets than a lower region. The upper region may have a height that is greater than the height of the lower region or vice versa. The upper region may have a height that is less than a height of the lower region or vice versa. The upper region and the lower region may have equal heights. Some or all of the reflector facets in the upper region, the lower region, or both may extend a full length (e.g., height) of the respective region. The upper region, the lower region, or both may have an even number of reflector facets or an odd number of reflector facets. The upper region may have a same number of reflector facets as the lower region or a different number of reflector facets as the lower region. The upper region, the lower region, or both may have an axis of symmetry. The axis of symmetry may be offset relative to a horizontal dividing line, a vertical dividing line, or both. For example, the center of the upper region, the lower region, or both may be located halfway between two edges and the axis of symmetry may be located offset from the center. The upper region, the lower region, or both may not include (i.e., may be free of) an axis of symmetry (e.g., the two sides may not be symmetrical). The upper region, the lower region, or both may have a dividing line that extends through a central reflector facet.

The dividing line functions to divide the upper region, the lower region, or both into a first region and a second region. The dividing line may be a center of a central reflector facet. The dividing line may be a center between a first edge and a second edge of a reflector. Preferably, the dividing line is a center of one reflector facet that is located in a center of the reflector. For example, if the reflector has five reflectors within an upper region the middle of the five reflectors may have a dividing line that extends therethrough dividing the upper region into a first region and a second region. The dividing line may be a vertical dividing line. The dividing line may be offset relative to the vertical dividing line. The vertical dividing line may bisect the reflector. The dividing line may only be present when there are an odd number of reflectors. The dividing line may be located within a center of a center reflector facet instead of a center of the reflector. The dividing line may not create mirror symmetry (e.g., vertically or horizontal (e.g., left to right)). The dividing line may not be located within an exact center of the reflector. The dividing line may be located within a center when the reflector has an even number of reflectors. The dividing line may be located within a center if the reflector facets are equally sized on each side of the dividing line or have a sum of widths that are equal on each side. Preferably, the dividing line forms a first region and a second region that have an even number of reflector facets or equal number of reflector facets and partial reflector facets in the first region and the second region.

The first region and the second region function to divide the reflector into two portions of reflector facets relative to a vertical line (i.e., the dividing line). The first region and the second region may be symmetrical. The first region and the second region may have portions that are symmetrical. The first region and the second region may be asymmetrical. The first region and the second region may have a sum of widths that are equal. For example, if each region has 3 or 3.5 reflector facets a sum of the width of each reflector facet may be equal. The first region and the second region may have a different sum of widths. The first region and the second region may have lengths (e.g., heights) that are equal. The lengths of the first region and the second region may be different. The first region and the second region may have an equal number of reflector facets. The first region and the second region may have a different number of reflector facets. The first region and the second region may have an equal number of reflector facets, partial reflector facets, or both. An area or width of the first region and the second region may differ despite an equal number of complete or partial reflector facets. The first region the second region or both may define a handedness of the reflector (e.g., a right side reflector or a left side reflector. For example, a smaller first region may direct less light to a first side of a car (e.g., a right side or a left side). The first region may have a greater width or area than the second region.

The first region may direct light to a first side of a dividing line of a vehicle. The first region may direct a majority (e.g., 50 percent or more, 60 percent or more, or 70 percent or more) of its light to a first side of a dividing line of a vehicle. Preferably, the first region may direct a majority of its light to a first side of a line extending along a side of a vehicle (e.g., a line that extends the length of the driver side or the passenger side of the vehicle). Thus, the light from the first region may primarily be directed to the driving surface in front of the vehicle and only some of the light will be directed to a region outside of the vehicle. The first region may direct some or all of its lights within a width of the vehicle. The first region may direct sun light within a width of the vehicle and some light outside a width of the vehicle. The first region may generally spread its light out evenly in front of the vehicle and in a region to a side of the vehicle. The first region and the second region may direct light to a same location so that the light overlaps. The first region may direct light to a first side of a line extending from a center of the reflector and the second region may direct light to a second side of the line extending from a center of the reflector.

The second region may direct light to a second side of a dividing line of a vehicle. The second region may direct a majority (e.g., 50 percent or more, 60 percent or more, or 70 percent or more) of its light to a second side of a dividing line of a vehicle. Preferably, the second region may direct a majority of its light to a second side of a line extending along a side of a vehicle (e.g., a line that extends the length of the driver side or the passenger side of the vehicle). Thus, the light from the second region may have some light directed to the driving surface in front of the vehicle and the light may be primarily directed to a region outside of the vehicle. The second region may direct some or all of its lights within a width of the vehicle. The second region may direct some light within a width of the vehicle and some light outside a width of the vehicle. The second region may generally spread its light out evenly in front of the vehicle and in a region to a side of the vehicle. The first region and the second region may each include a portion of a center reflector facet.

The central reflector facet functions to form a center facet or has a dividing line extend through the lower region or the upper region. The central reflector facet may be a center reflector facet when there are an odd number of reflector facets. When there are an even number of reflector facets the dividing line may extend through the central reflector facet such that the dividing line is also the vertical dividing line. The central reflector facet may be the largest facet of the reflector. The central reflector facet may be larger than any other facet within a row or column. The central reflector facet may be a same size as other reflector facets. The central reflector facet may be smaller than some other reflector facets. The central reflector facet may have mirror symmetry with an adjacent central reflector facet opposite a horizontal dividing line.

The horizontal dividing line functions to divide the upper region and the lower region. The upper region and the lower region may have mirror symmetry, a mirror reflector facet, or both. The horizontal dividing line may be an axis of symmetry between the upper region and the lower region. The horizontal dividing line may extend between the upper region and the lower region regardless of a length or area of the upper region and the lower region. The horizontal dividing line may extend between the upper region and the lower region and there may not be symmetry above and below the horizontal dividing line. The upper region and the lower region may be angled relative to one another about the horizontal dividing line. The upper region and the lower region may form an angle relative to each other. The angle may be about 115 degrees or more, about 135 degrees or more, about 150 degrees or more, or about 160 degrees or more. The angle may be about 180 degrees or less, about 175 degrees or less, or about 165 degrees or less. The horizontal dividing line may be located between two regions and may not necessarily be located at a center. For example, if there is a break in the reflector between the upper region and the lower region the horizontal dividing line may extend along the break even if the length of the upper region and the lower region vary. The horizontal dividing line and the vertical dividing line may cross (e.g., have a perpendicular intersection).

The vertical dividing line functions to divide the first region and the second region. The vertical dividing line may extend vertically to horizontally bisect the reflector to form the first region and the second region. The vertical dividing line may extend through a center of the reflector. The vertical dividing line may extend through a central reflector facet. The vertical dividing line may form an axis that the first region and the second region are angled relative to or bend relative to so that the reflector has an angled shape. The vertical dividing line may extend along a break in the reflector. The first region and the second region may be separated by an angle may be about 115 degrees or more, about 135 degrees or more, about 150 degrees or more, or about 160 degrees or more. The first region and the second region may be separated by an angle of about 180 degrees or less, about 175 degrees or less, or about 165 degrees or less. The horizontal dividing line and the vertical dividing line may affect the cut-off.

The cut-off may function to be an edge of reflected light formed by the reflector. The cut-off may be located at a top edge, a bottom edge, a side edge, or a combination thereof of the reflected light. The cut-off may be a line the light does not pass. The cut-off may be linear. The cut-off may be straight. The cut-off may be planar. The cut-off may have a sharp edge. The cut-off may be a precise line that demarcates a termination of light. The cut-off may be a single line. The cut-off may be free of more than one line. For example, the cut-off may be a single horizontal line and the cut-off may be free any other lines that extend at any angle relative to the cut-off. The cut-off may be a single line that extends parallel to the horizon. of a second lien that extends at an angle relative to the first cut-off line forming a second cut-off line. The cut-off may be free of any angle changes, second lines, third lines, or a combination thereof. The cut-off, illuminated region, isocandela showing the illuminated region, or a combination thereof may be free of a 15 degree cut-off. The cut-off may be within an SAE pattern. The cut-off may be formed by light reflected from one or more, two or more, three or more, or four or more reflector facets of a reflector. The cut-off may be formed by light reflected from 10 or less, 8 or less, 6 or less, 4 or less, 3 or less, 2 or less, or 1 reflector facet of a reflector. For example, light may be generated by a light source and the light may be directed to a reflector with a plurality of reflector facts, which reflect the light to a predetermined region. The light has a cut-off. The cut-off may be formed by three or less reflector facets of a reflector. The cut-off may be formed by reflector facets in the upper region, the lower region, the first region, the second region, or a combination thereof. For example, the cut-off may be formed by reflector facets that are in the lower region and the second region and the reflector facets in the other regions direct light around the cut-off.

The cut-off may be monitored at different distances. An amount of intensity of the light may be measured above the cut-off one or more distances and the intensity may determine if the cut-off is planar, sharp, linear, or a combination thereof. The distance of measurement may be about 20 m or more, about 30 m or more, 40 m or more, about 50 m or more, about 60 m or more, or about 70 m or more. The distance measured may be about 200 m or less, about 175 m or less, about 150 m or less, about 125 m or less, about 100 m or less, or about 80 m or less. The distance of measurement may vary depending on whether the low beams or the high beams are being measured. The distance may be varied depending on whether the intensity is being measured directly in front of the vehicle (e.g., a straight away), at a curve relative to the vehicle (e.g., a right curve or a left curve), or what distance along a curve the measurement is being taken (e.g., 150 m to the right or left, 250 m to the right or left); or a combination thereof. The cut-off may be measured for an intensity level beyond a cut-off at predetermined distances. The intensity level may be about 1 lux or more, about 3 lux or more, or about 5 lux or more. The intensity level may be about 20 or less, about 15 or less, or about 10 or less. The intensity level beyond a cut-off may be monitored until the intensity exceeds a predetermined intensity level and then the quality of the cut-off may be determined. In one example, if the predetermined intensity level is 5 lux a light meter may be placed beyond the cut-off to measure an amount of light that strays past the cut-off. The light meter may be moved away from the light source while being maintained beyond but proximate to the cut-off while monitoring the intensity of the light. Once the intensity of light reaches 5 lux the distance from the light source is recorded. The circumstances surrounding the measurement are also recorded and the quality of the cut-off can then be determined. The greater the distance from the light source before the lux reaches the predetermined intensity level the more quality (e.g., planar, sharp, precise) the cut-off is. One such test that may be used is the headlight test and rating protocol (Version III) from the Insurance Institute for Highway Safety system (IIHS) of July 2018, the teachings of which are expressly incorporated by refence herein for all purposes. The cut-off may be viewed or measured in an isocandela.

The isocandela functions to predictively model the intensity of light produced, reflected, or both. The isocandela may illustrate intensity of a light or reflector to predetermined regions. The isocandela may be broken into one or more partial isocandelas to predictively model how light from each reflector facet may be reflected so that each reflector facet may be adjusted or changed individually.

The hot spot functions to be an area with a highest concentration of light, the greatest intensity of light, or both. The hot spot may be located within any portion of an illuminated area, the reflected light, an isocandela demonstrating the light pattern, or a combination thereof. The hot spot may be located adjacent to the cut-off. The hot spot may abut the cut-off. One side of the hot spot may terminate at the cut-off. The hot spot may be formed by one or more reflector facets, two or more reflector facets, three or more reflector facets, or four or more reflector facets. The hot spots may be formed by ten or less reflector facets, eight or less reflector facets, six or less reflector facets, or five or less reflector facets. The hot spot may have an intensity of about 20,000 cd or more, about 30,000 cd or more, about 40,000 cd or more, or about 45,000 cd or more. The hot spot may have an intensity of about 100,000 cd or less, about 75,000 cd or less, about 60,000 cd or less, or about 50,000 cd or less.

FIG. 1 illustrates a side view of a vehicle 2 including a light system 10. The light system 10 includes a light source 12 and reflectors 14 that project light through a lens 26 in front of the vehicle 2 so that items are illuminated by light 40 as the vehicle moves in the direction 4.

Figure 2:
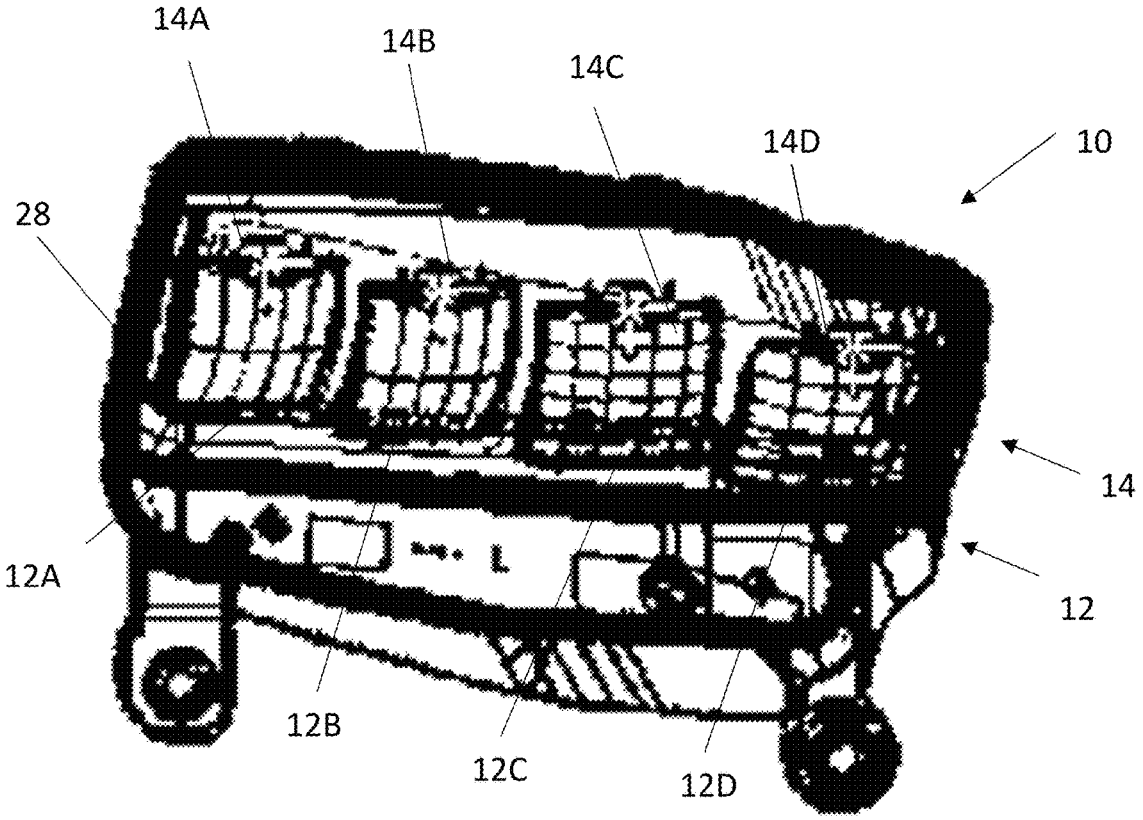
FIG. 2 is a front plan view of a light system.

FIG. 2 is a front plan view of a light system 10 comprising a housing 28 with a plurality of reflectors 14 and lights 12. The plurality of lights 12 include a first light 12A, second light 12B, third light 12C, and fourth light 12D aligned with a first reflector 14A, a second reflector 14B, a third reflector 14C, and a fourth reflector 14D respectively.

Figure 3A:
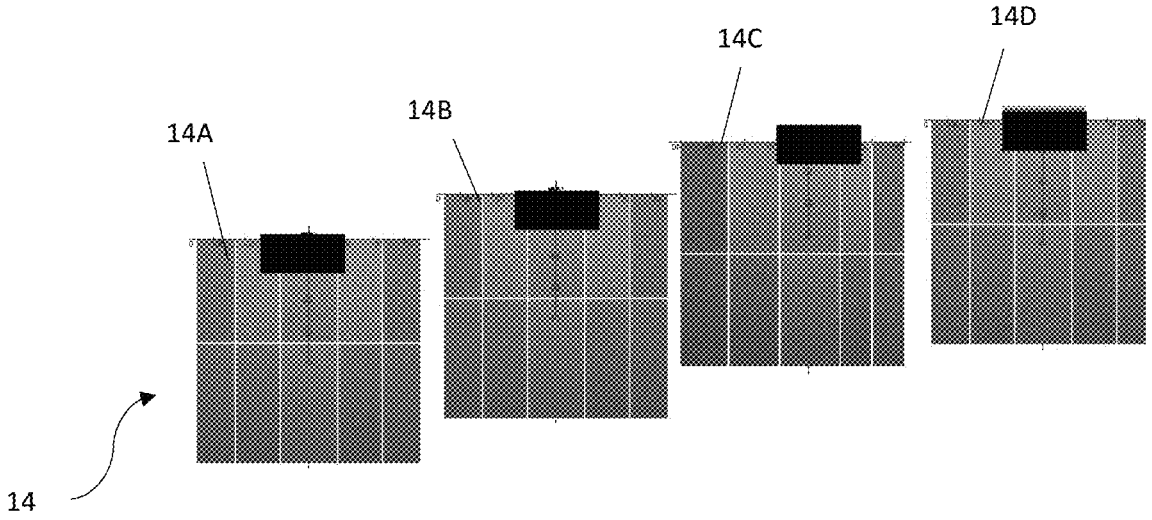
FIG. 3A illustrates a plan view of reflectors of the light system.

FIG. 3A is a plan view of a plurality of reflectors 14 aligned proximate to one another. The plurality of reflectors include a first reflector 14A, a second reflector 14B, a third reflector 14C, and a fourth reflector 14D.

Figure 3B:
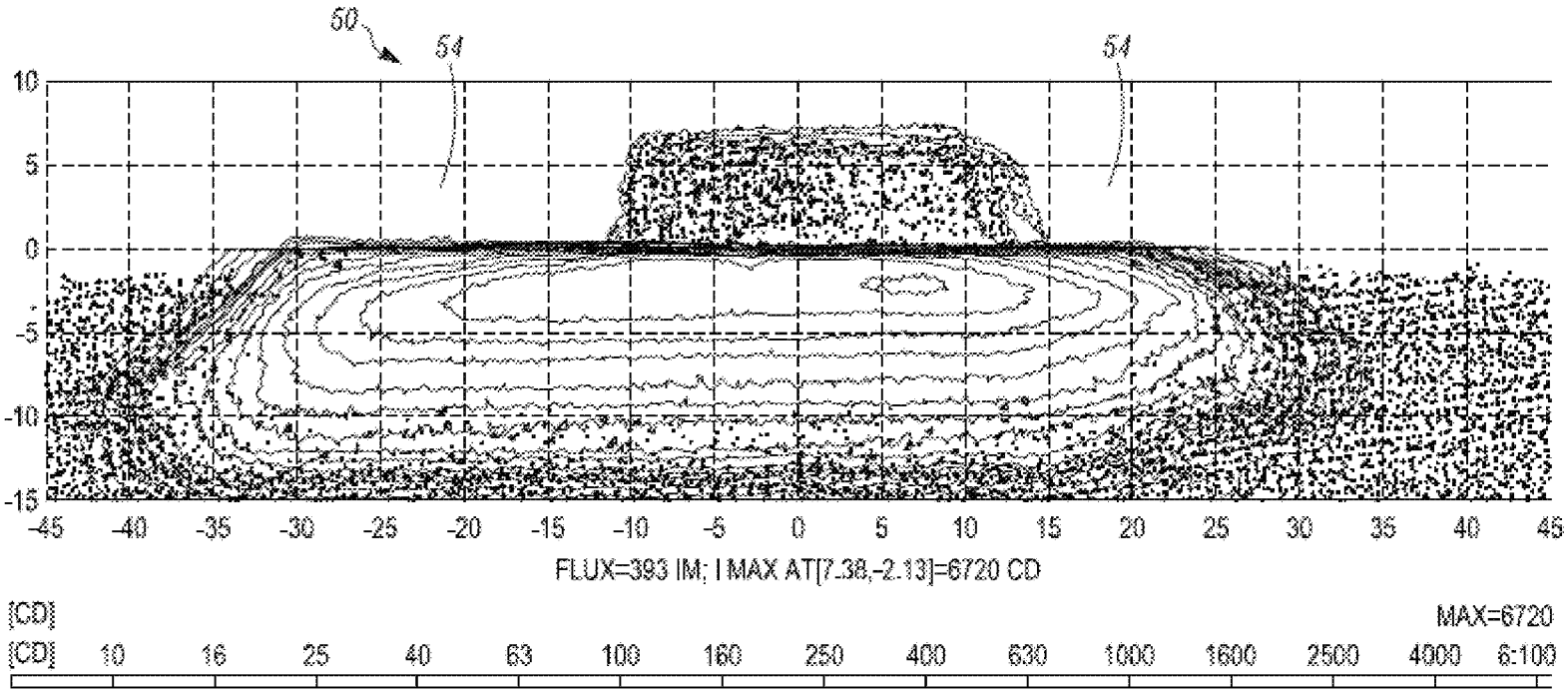
FIG. 3B illustrates an isocandela formed by the reflectors of the light system of FIG. 3A.

FIG. 3B is an isocandela 50 formed by the plurality of reflectors of FIG. 3A. The isocandela 50 includes cut-offs 54 that are linear and have a sharp edge.

Figure 4A:
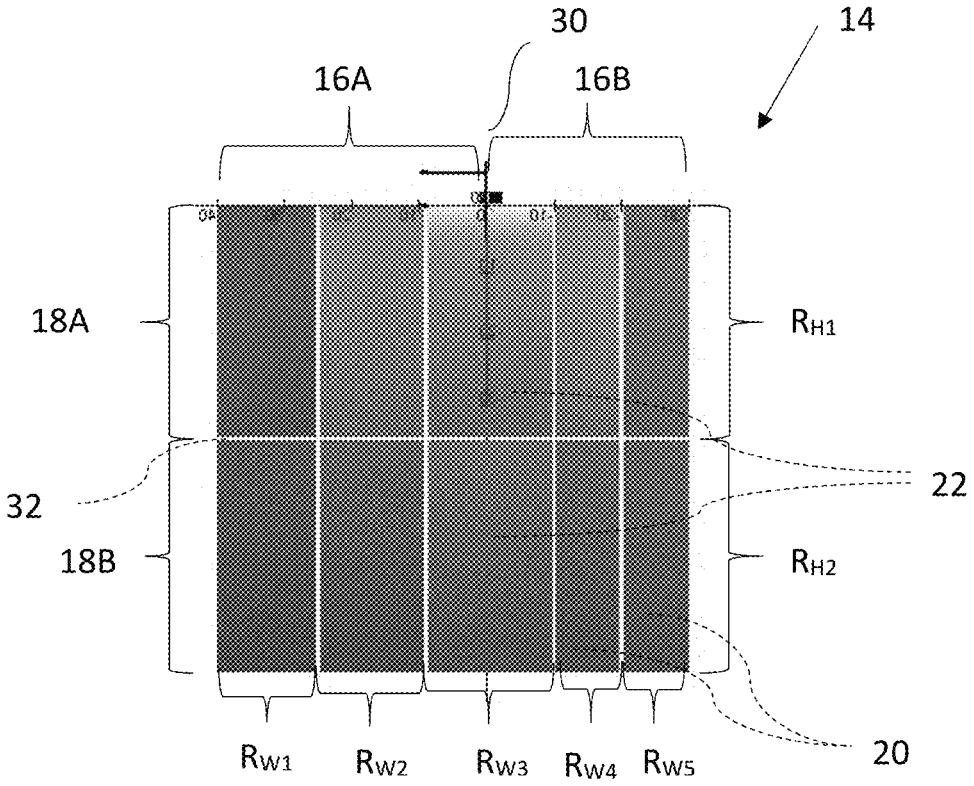
FIG. 4A is a plan view of a reflector.

FIG. 4A is a plan view of a reflector 14 including a plurality of reflector facets 20. The reflector facets 20 are divided in a width direction by a vertical dividing line 30 that forms first region 16A and a second region 16B. As shown, the first region 16A and the second region 16B have different widths and the vertical dividing line 30 is not located at a mid-point between the two opposing edges (e.g., the first region 16B and the second region 16B are not symmetrical) but is located in a center of a central reflector facet 22. The width of the reflector 14 includes five reflector facets 20 having different widths and the widths from a first edge to a second edge are show as RW1, RW2, RW3, RW4, and RW5. As shown, RW3>RW1, RW2, RW4, and RW5. As shown, RW1=RW2 and RW4=RW5. Finally, RW1 and RW2>RW4 and RW5. The reflector 14 is also vertically divided so that the plurality of reflectors form an upper region 18A and a lower region 18B divided by a horizontal dividing line 32. As shown, the upper region 18A and the lower region 18B have a same number of reflector facets 20.

The upper region 18A has a height RH1 and the lower region 18B has a height RH2. As shown, RH1≤RH2.

Figure 4B:
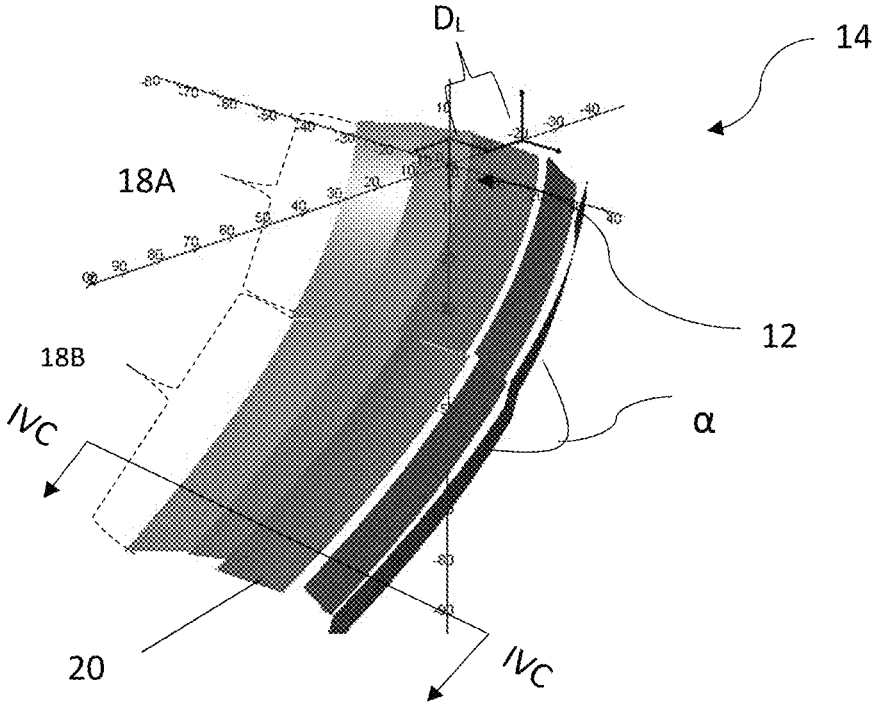
FIG. 4B is a perspective view of a reflector.

FIG. 4B is a perspective view of a reflector 14 including a plurality of reflector facets 20. The upper region 18A and the lower region 18B extend at an angle (α) relative to each other. The light source 12 is located a distance ($D_L$) from the reflector 14. The distance (DO is a focal length of the light source 12 to provide the cut-off (not shown) taught herein.

Figure 4C:
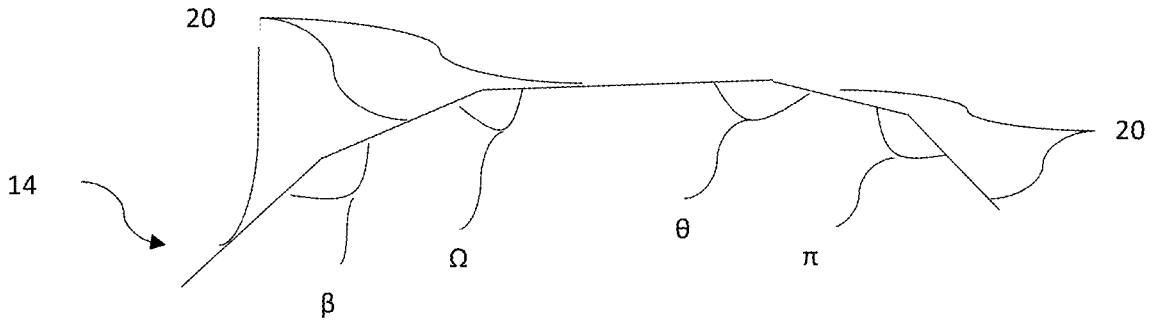
FIG. 4C is a cross-sectional view of the reflector of FIG. 4B.

FIG. 4C is a cross-sectional view of FIG. 4B along line IVC. The plurality of reflector facets 20 of the reflector 14 are shown with the reflector facets extending at the angles (β), (Ω), (θ), and (π) relative to two adjacent reflector facets 20.

Figure 5:
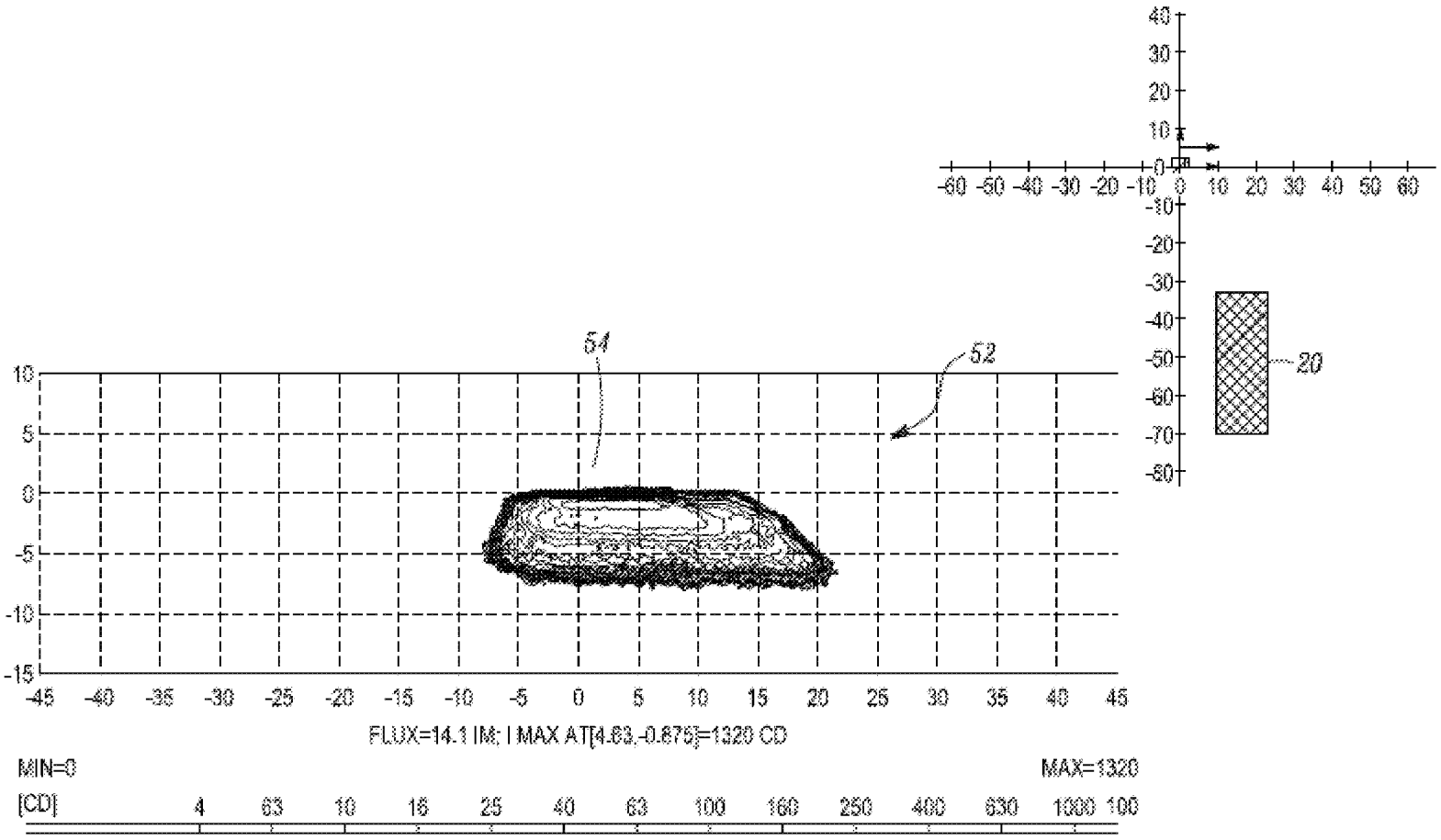
FIG. 5 is a partial isocandela formed by one reflector facet shown alongside.

FIG. 5 illustrates a partial isocandela 52 having a cut-off 54. The partial isocandela 52 is located within a grid pattern similar to the grid pattern of FIG. 3B so that the region lighted by the reflector facet 20 is demonstrated relative to the larger overall isocandela. The reflector facet 20 shown creates the partial isocandela 52 and is located in the lower region and has the width RW4.

Figure 6:
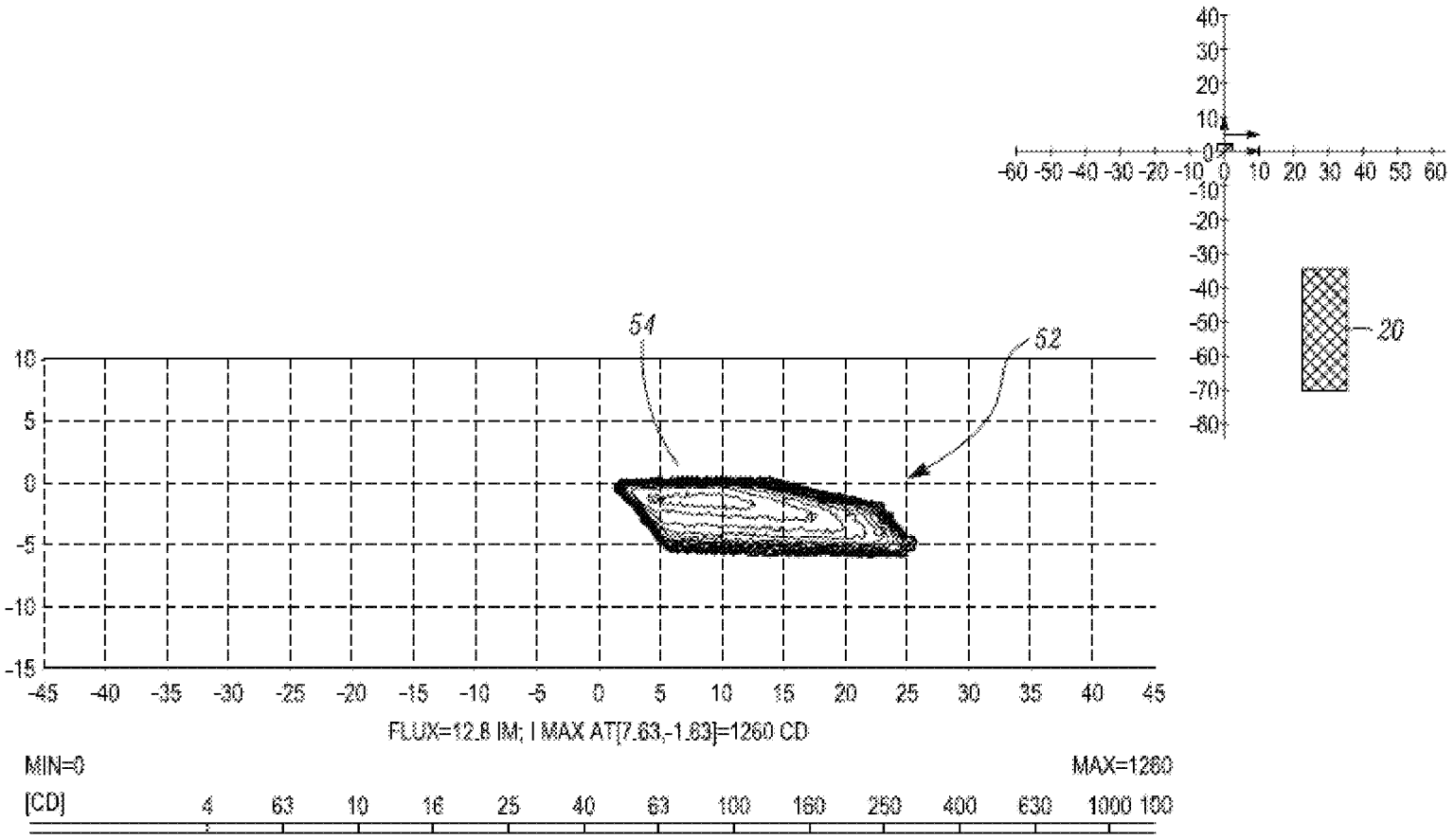
FIG. 6 is a partial isocandela formed by one reflector facet shown alongside.

FIG. 6 illustrates a partial isocandela 52 having a cut-off 54. The partial isocandela 52 is located within a grid pattern similar to the grid pattern of FIG. 3B so that the region lighted by the reflector facet 20 is demonstrated relative to the larger overall isocandela. The reflector facet 20 shown creates the partial isocandela 52 and is located in the lower region and has the width RW5. The linearity and sharp edge formed in the partial isocandela of FIGS. 5 and 6 overlap such that if one edge is not sharp or linear the cut-off 54 of the entire isocandela will be changed.

Figure 7:
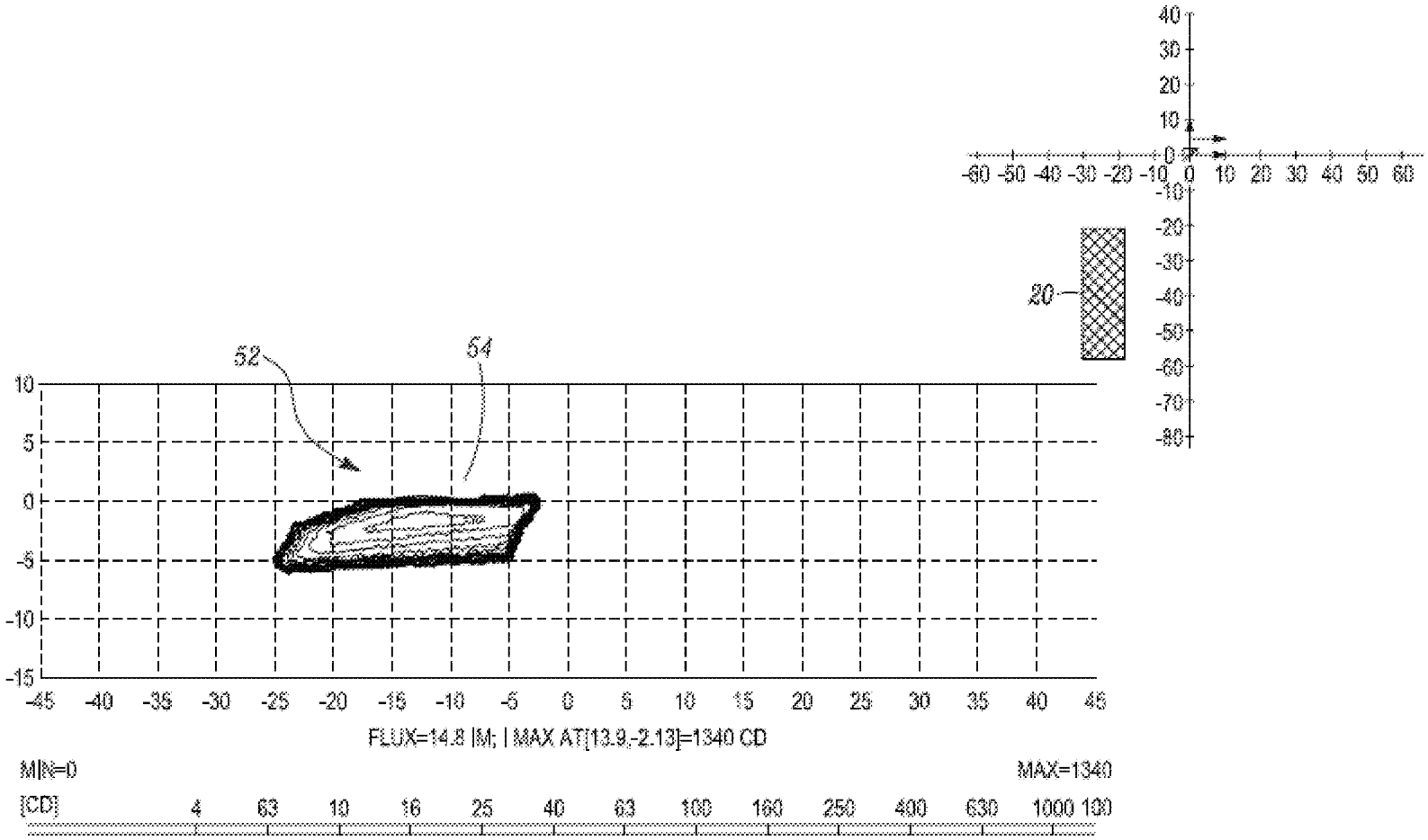
FIG. 7 is a partial isocandela formed by one reflector facet shown alongside.

FIG. 7 illustrates a partial isocandela 52 having a cut-off 54. The partial isocandela 52 is located within a grid pattern similar to the grid pattern of FIG. 3B so that the region lighted by the reflector facet 20 is demonstrated relative to the larger overall isocandela.

Figure 8:
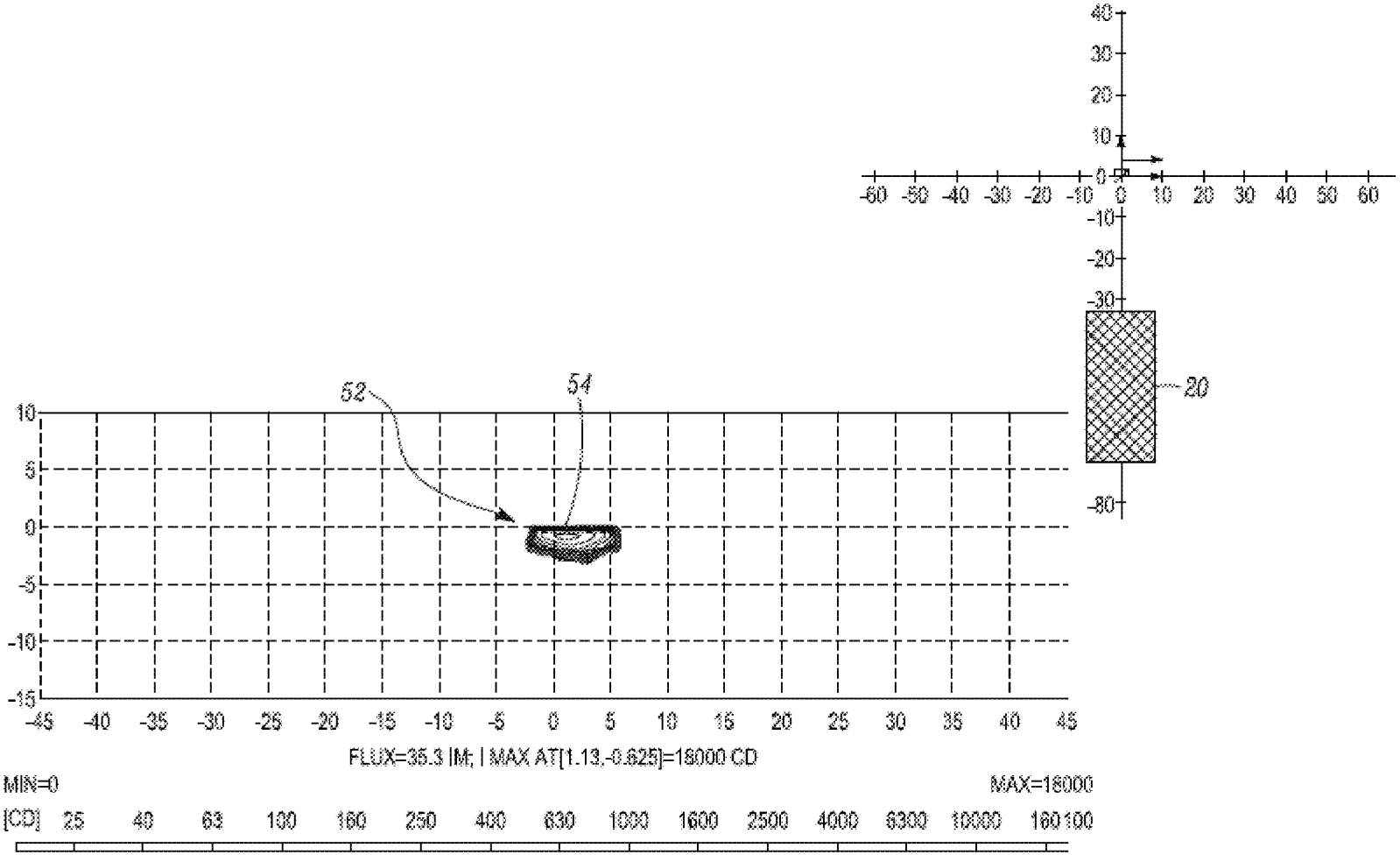
FIG. 8 is a partial isocandela formed by one reflector facet shown alongside.

FIG. 8 illustrates a partial isocandela 52 having a cut-off 54. The partial isocandela 52 is located within a grid pattern similar to the grid pattern of FIG. 3B so that the region lighted by the reflector facet 20 is demonstrated relative to the larger overall isocandela.

Figure 9A:
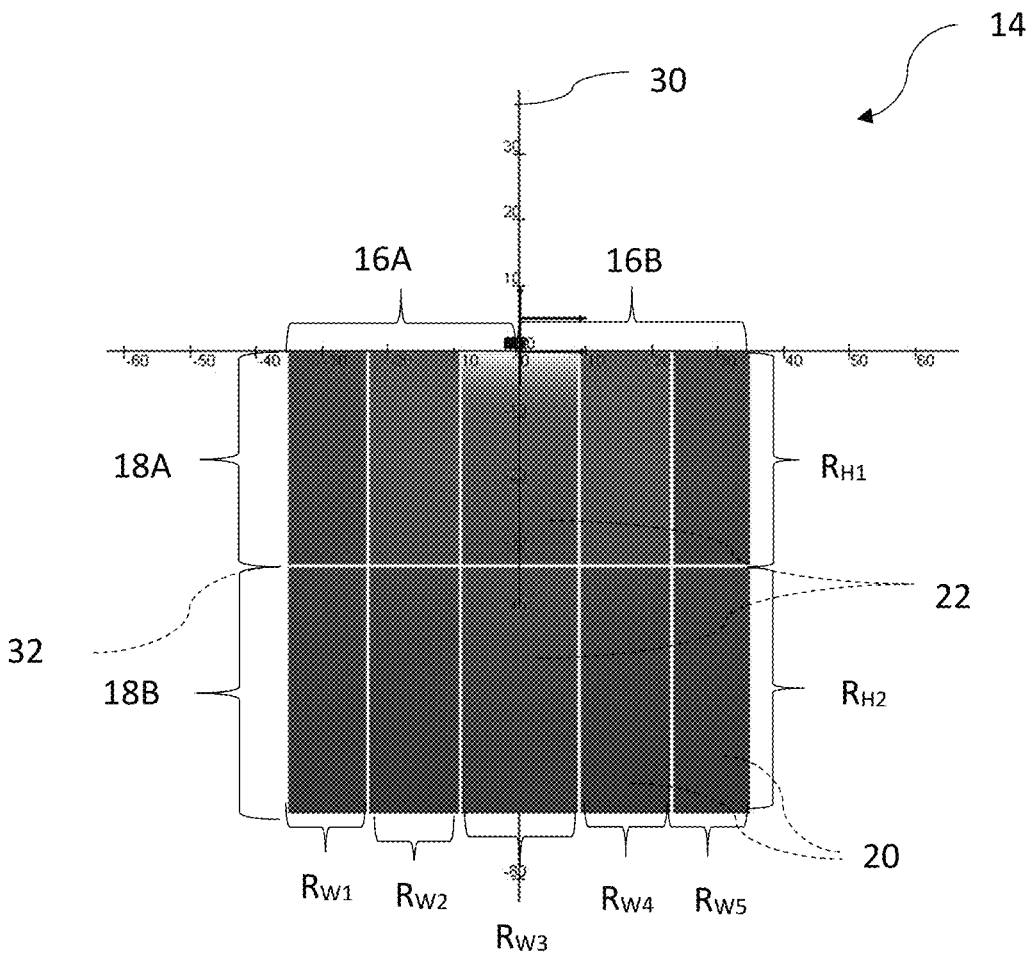
FIG. 9A is a plan view of a reflector.

FIG. 9A is a plan view of a reflector 14 including a plurality of reflector facets 20. The reflector facets 20 are divided in a width direction by a vertical dividing line 30 that forms first region 16A and a second region 16B. As shown, the first region 16A and the second region 16B have different widths and the vertical dividing line 30 is not located at a mid-point between the two opposing edges (e.g., the first region 16B and the second region 16B are not symmetrical) but is located in a center of a central reflector facet 22. The width of the reflector 14 includes five reflector facets 20 having different widths and the widths from a first edge to a second edge are show as RW1, RW2, RW3, RW4, and RW5. As shown, RW3>RW1, RW2, RW4, and RW5. As shown, RW1=RW5 and RW2=RW5. Finally, RW1 and RW5≤RW4 and RW2. The reflector 14 is also vertically divided so that the plurality of reflectors form an upper region 18A and a lower region 18B divided by a horizontal dividing line 32. As shown the upper region 18A and the lower region 18B have a same number of reflector facets 20. The upper region 18A has a height RH1 and the lower region 18B has a height RH2. As shown, RH1<RH2.

Figure 9B:
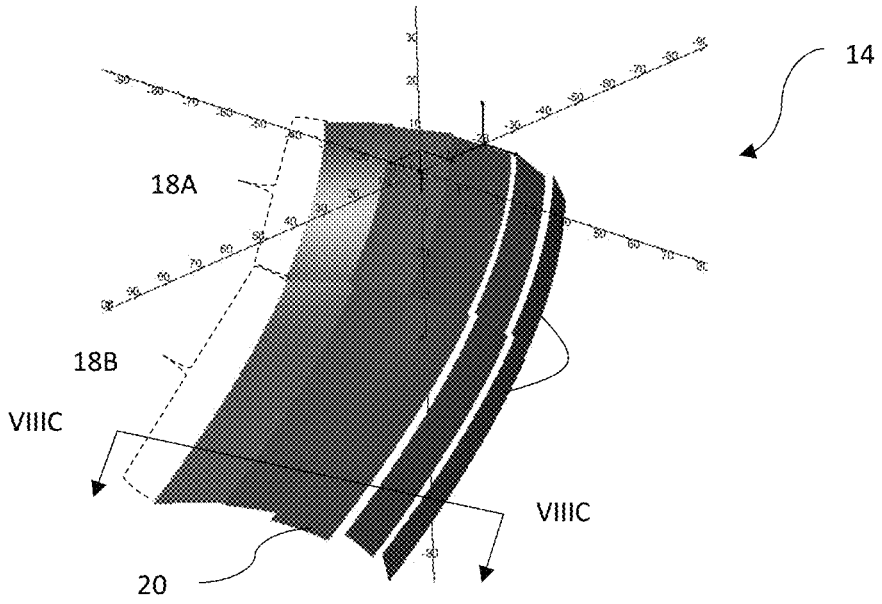
FIG. 9B is a perspective view of a reflector.

FIG. 9B is a perspective view of a reflector 14 including a plurality of reflector facets 20. The upper region 18A and the lower region 18B extend at an angle (a) relative to each other.

Figure 9C:
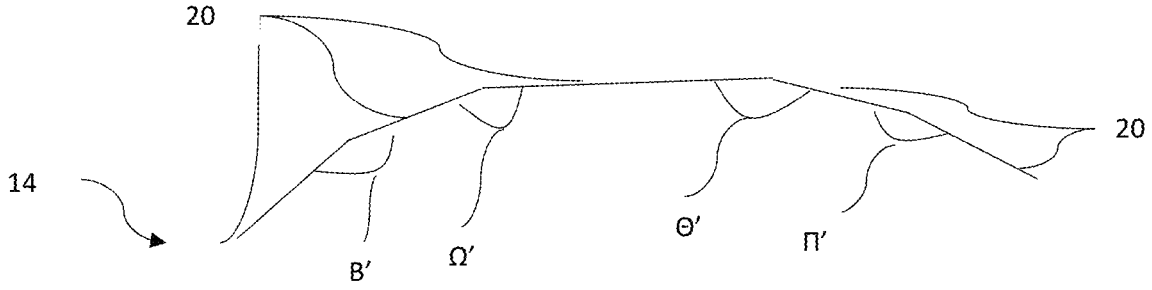
FIG. 9C is a cross-sectional view of the reflector of FIG. 9B.

FIG. 9C is a cross-sectional view of FIG. 8B along line VIIIC. The plurality of reflector facets 20 of the reflector 14 are shown with the reflector facets extending at the angles (β), (Ω), (θ), and (π) relative to two adjacent reflector facets 20.

Figure 10A:
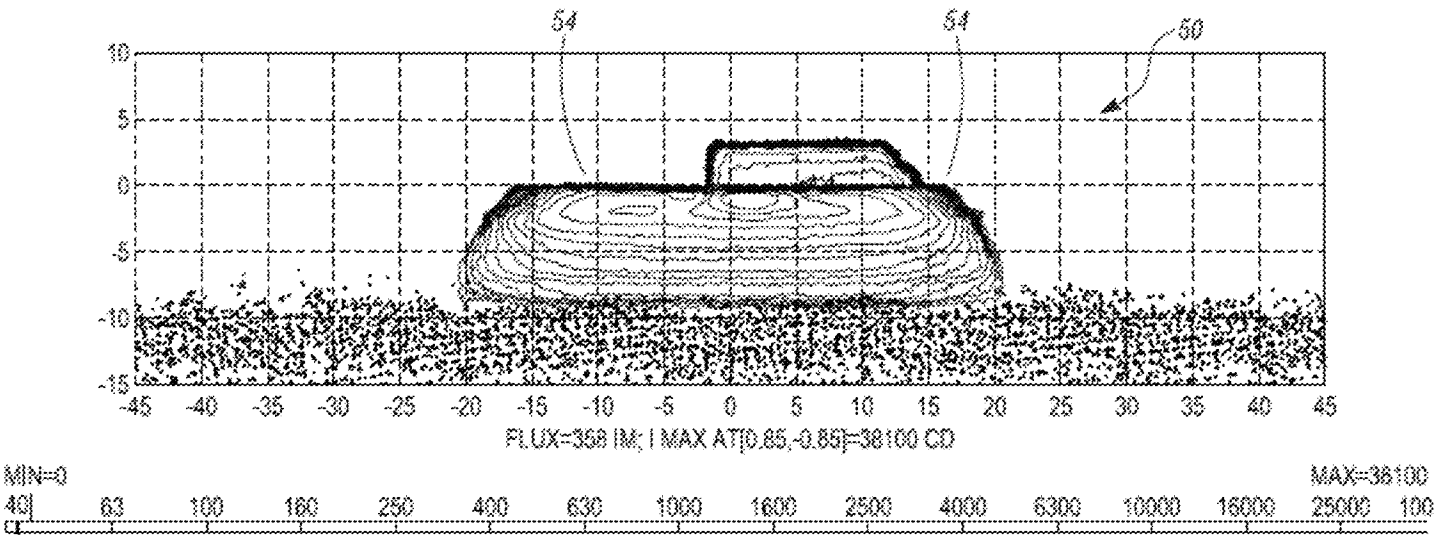
FIG. 10A illustrates an isocandela.

FIG. 10A is a complete isocandela 50 with cutoffs 54.

Figure 10B:
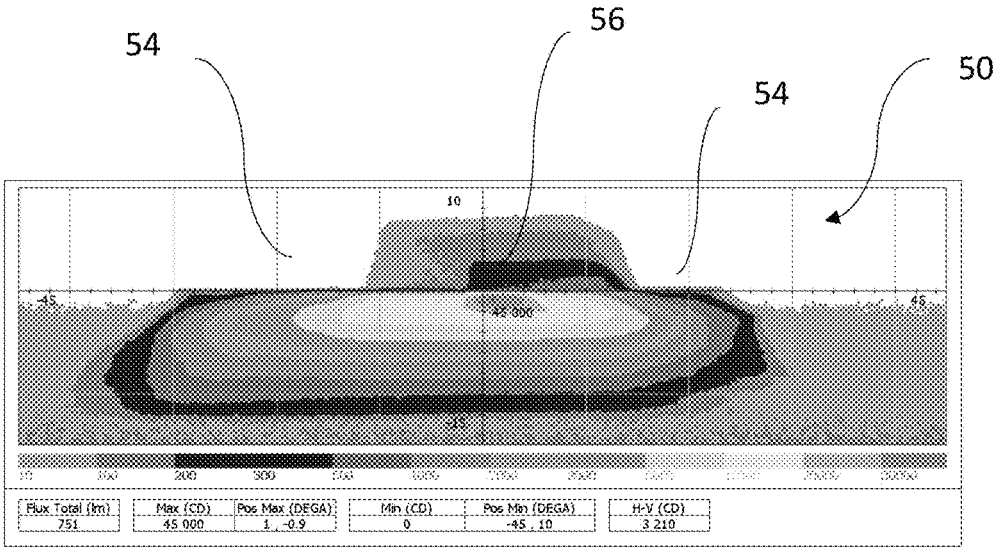
FIG. 10B illustrates a heat map isocandela.

FIG. 10B is a heat map isocandela 50 of FIG. 10A showing the cutoffs 54 and the hot spot 56 located proximate to the cutoffs 54 with the hot spot 56 being cutoff.

Figure 10C:
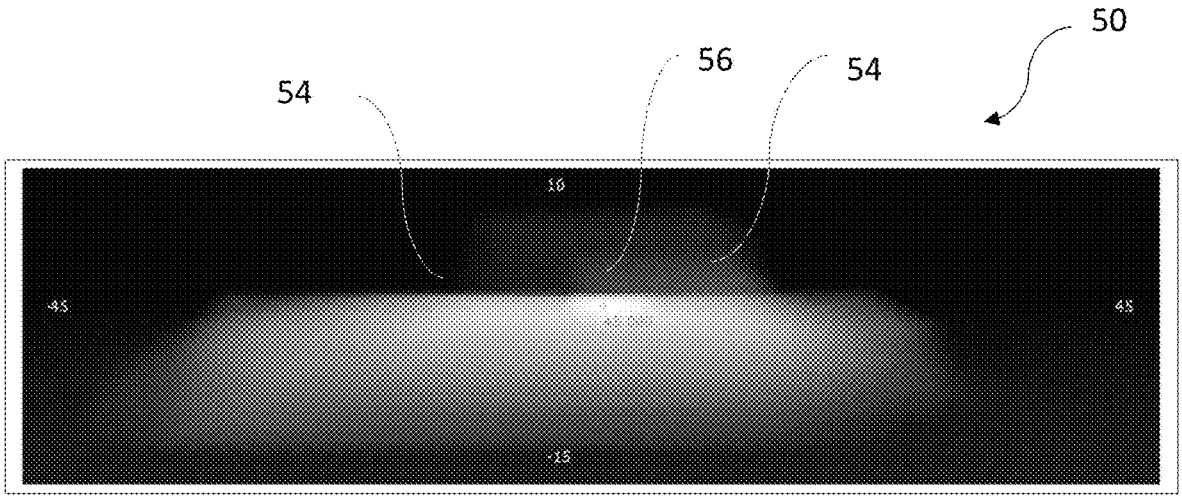
FIG. 10C illustrates a grey scale model of an illuminated region.

FIG. 10C a grey scale isocandela 50 of FIG. 10A showing the cutoffs 54 and the hot spot 56 located proximate to the cutoffs 54 with the hot spot 56 being cutoff.

Figure 11:
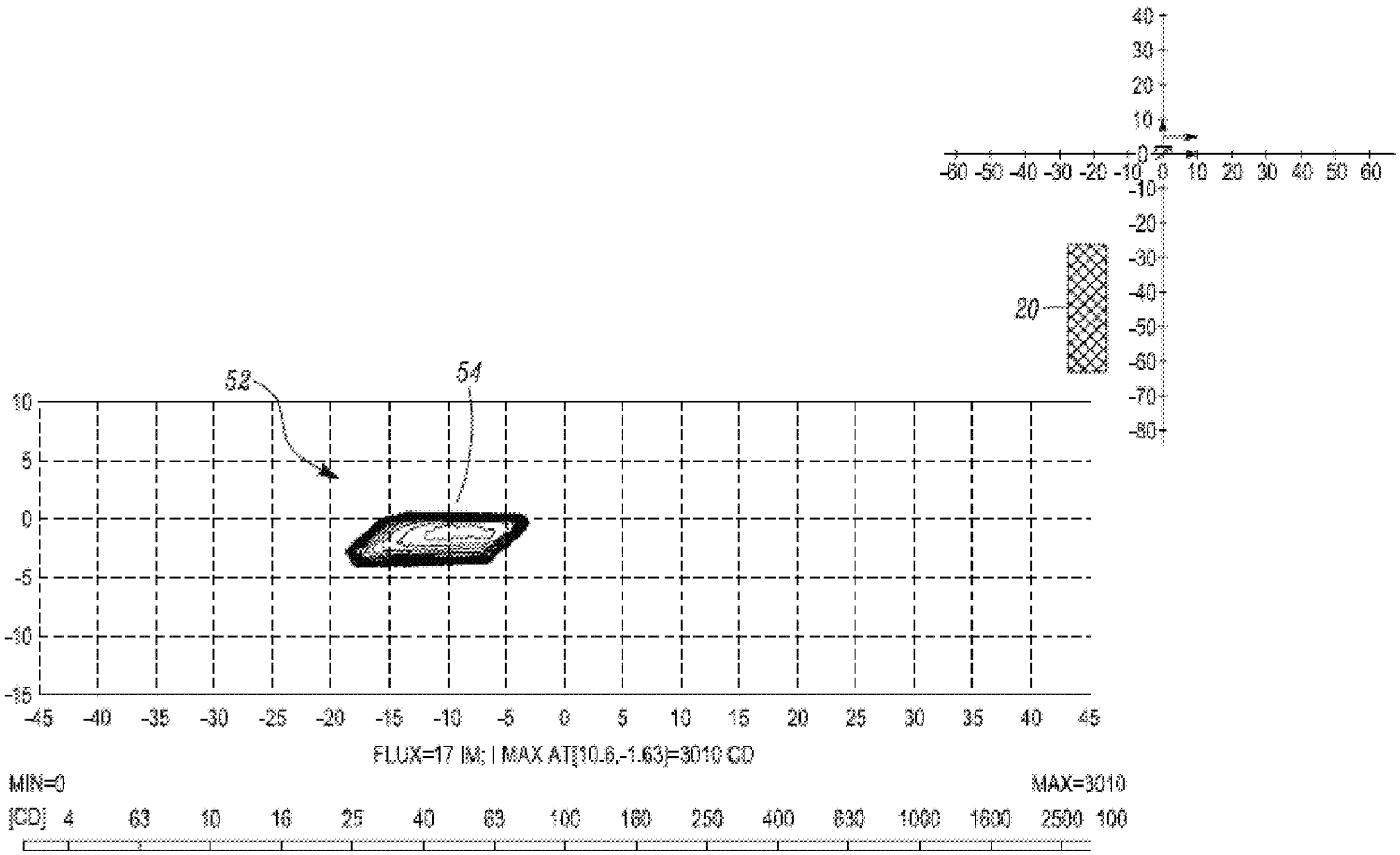
FIG. 11 is a partial isocandela formed by one reflector facet shown alongside.

FIG. 11 is a partial isocandela 52 with a cutoff 54 formed by the reflector facet 20.

Figure 12:
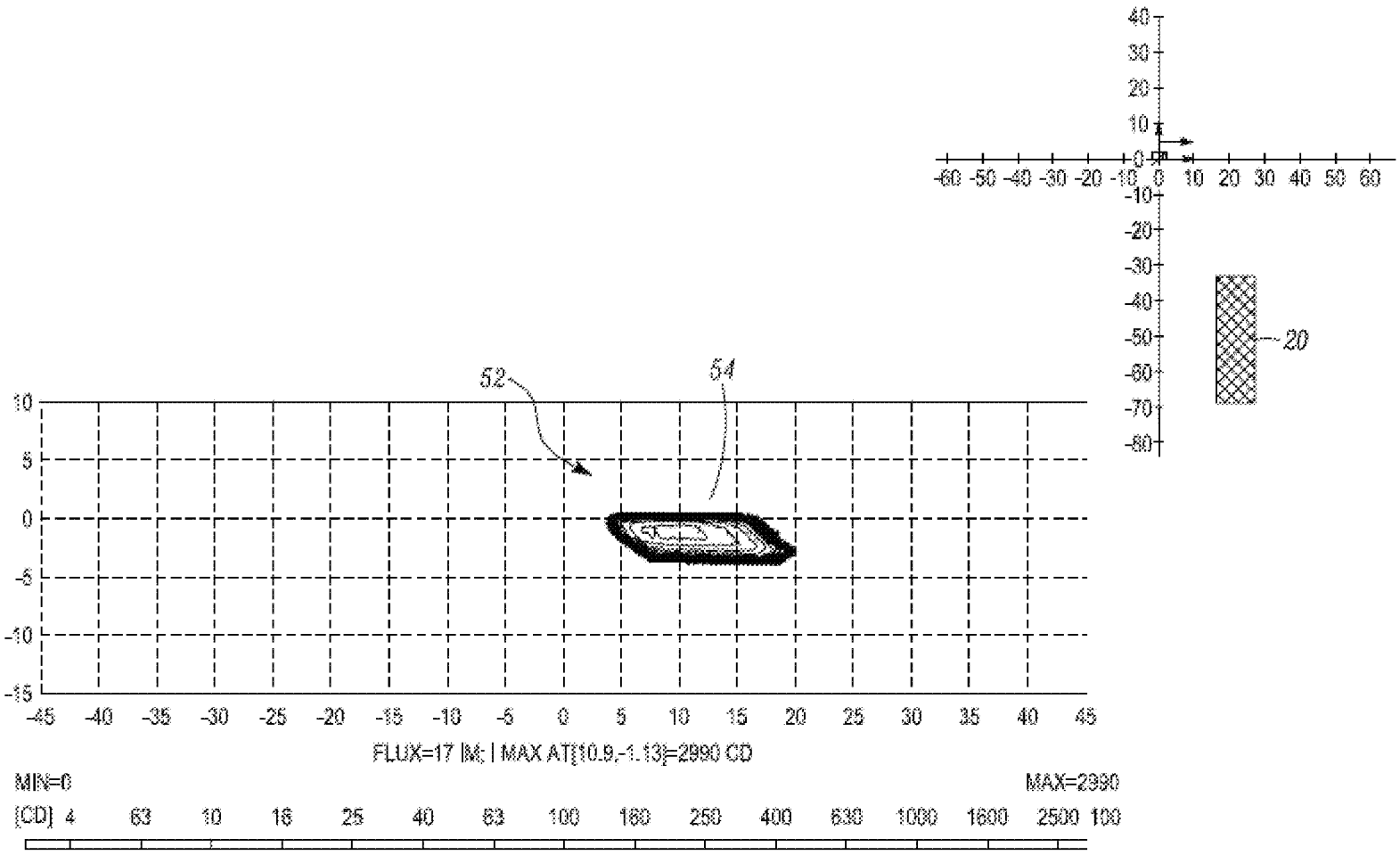
FIG. 12 is a partial isocandela formed by one reflector facet shown alongside.

FIG. 12 is a partial isocandela 52 with a cutoff 54 formed by the reflector facet 20.

Variation 1 may comprise: a light system comprising: (a) a plurality of light sources; (b) a plurality of reflectors that are each aligned with and reflect one or more of the plurality of light sources in a first direction away from a vehicle that houses the light system, wherein at least one of the plurality of reflectors comprises: (i) a plurality of reflector facets; (ii) a vertical dividing line that extends through a central reflector facet; and (iii) an equal number of the plurality of reflector facets in a first region on a first side of the vertical dividing line and second region on a second side of the vertical dividing line; wherein the second region has a width from the vertical dividing line that is less than a width of the first region from the vertical dividing line.

Variation 2 may comprise variation 1 and wherein the width of some of the reflector facets in the first region, the second region, or both are equal.

Variation 3 may comprise any of variations 1-2 and wherein the width of all of the reflector facets in the first region, the second region, or both are equal.

Variation 4 may comprise any of variations 1-3 and wherein the width of all of the reflector facets in the first region, the second region, or both are different.

Variation 5 may comprise any of variations 1-4 and wherein the at least one of the plurality of reflectors comprises: (a) an upper region comprising some of the plurality of reflector facets, the plurality of reflector facets each having a width and (b) a lower region comprising some of the plurality of reflector facets, the plurality of reflector facets each having a width; and wherein each of the reflector facets of the upper region have a mirror reflector facet in the lower region and the width of the mirror reflector facet in the upper region is equal to the width of the mirror reflector facet in the lower region.

Variation 6 may comprise any of variations 1-5 and wherein the plurality of reflector facets in the upper region, the lower region, or both extend a full vertical length of the upper region or the lower region.

Variation 7 may comprise any of variations 1-6 and wherein the plurality of reflector facets reflect light from the light source and the light has a cut-off where a light intensity beyond the cut-off is about 5 lux or less at a distance of 50 m or more.

Variation 8 may comprise any of variations 1-7 and wherein the distance is 70 m or more.

Variation 9 may comprise any of variations 1-8 and wherein the distance is 100 m or more.

Variation 10 may comprise any of variations 1-9 and wherein the plurality of reflector facets of one of the plurality of reflectors reflect light to a predetermined region and the reflected light has a cut-off formed by three of the plurality of reflector facets or less.

Variation 11 may comprise A light system comprising: (a) a plurality of light sources; (b) a plurality of reflectors that are each aligned with and reflect light from one or more of the plurality of light sources in a first direction away from a vehicle that houses the light system, wherein at least one of the plurality of reflectors comprises: (i) a plurality of reflector facets; (ii) a vertical dividing line that extends through the at least one of the plurality of reflectors; (iii) a first region extending from a first side of the vertical dividing line to a first edge; and (iv) a second region extending from a second side of the vertical dividing line to a second edge that is located opposite the first edge; and wherein the second region has a width is less than a width of the first region.

Variation 12 may comprise any of variations 1-11 and wherein some or all of the plurality of reflector facets in the first region, some or all of the plurality of reflector facets in the second region, or both have a width that is different from one another.

Variation 13 may comprise any of variations 1-12 and wherein the dividing line extends through a center of one or more of the reflector facets and extends through a location other than a center of one of the plurality of reflectors.

Variation 14 may comprise any of variations 1-13 and wherein some of the plurality of reflector facets of a reflector redirect the light from one of the plurality of light sources away form the vehicle to a first region and the redirected light has a cut-off.

Variation 15 may comprise any of variations 1-14 and wherein the cut-off is formed by three of the plurality of reflector facets or less.

Variation 16 may comprise any of variations 1-15 and wherein a light intensity beyond the cut-off is about 5 lux or less at a distance of 50 m or more.

Variation 17 may comprise any of variations 1-16 and wherein the distance is 100 m or more.

Variation 18 may comprise any of variations 1-17 and wherein the reflector includes an upper region and a lower region and the redirected light forming the cut-off is redirected from one or more reflector facets located in both the second region and the lower region.

Variation 19 may comprise any of variations 1-18 and wherein the upper region has a length and the lower region has a length and the length of the lower region is greater than the length of the upper region.

Variation 20 may comprise any of variations 1-19 and wherein a width of all of the reflector facets in the first region, the second region, or both are different.

Any numerical values recited herein include all values from the lower value to the upper value in increments of one unit provided that there is a separation of at least 2 units between any lower value and any higher value. As an example, if it is stated that the amount of a component or a value of a process variable such as, for example, temperature, pressure, time and the like is, for example, from 1 to 90, preferably from 20 to 80, more preferably from 30 to 70, it is intended that values such as 15 to 85, 22 to 68, 43 to 51, 30 to 32 etc. are expressly enumerated in this specification. For values which are less than one, one unit is considered to be 0.0001, 0.001, 0.01 or 0.1 as appropriate. These are only examples of what is specifically intended and all possible combinations of numerical values between the lowest value and the highest value enumerated are to be considered to be expressly stated in this application in a similar manner.

Unless otherwise stated, all ranges include both endpoints and all numbers between the endpoints. The use of "about" or "approximately" in connection with a range applies to both ends of the range. Thus, "about 20 to 30" is intended to cover "about 20 to about 30", inclusive of at least the specified endpoints.

The disclosures of all articles and references, including patent applications and publications, are incorporated by reference for all purposes. The term "consisting essentially of" to describe a combination shall include the elements, ingredients, components or steps identified, and such other elements ingredients, components or steps that do not materially affect the basic and novel characteristics of the combination. The use of the terms "comprising" or "including" to describe combinations of elements, ingredients, components or steps herein also contemplates embodiments that consist essentially of or even consists of the elements, ingredients, components or steps.

Plural elements, ingredients, components or steps can be provided by a single integrated element, ingredient, component or step. Alternatively, a single integrated element, ingredient, component or step might be divided into separate plural elements, ingredients, components or steps. The disclosure of "a" or "one" to describe an element, ingredient, component or step is not intended to foreclose additional elements, ingredients, components or steps.

It is understood that the above description is intended to be illustrative and not restrictive. Many embodiments as well as many applications besides the examples provided will be apparent to those of skill in the art upon reading the above description. The scope of the invention should, therefore, be determined not with reference to the above description, but should instead be determined with reference to the appended claims, along with the full scope of equivalents to which such claims are entitled. The disclosures of all articles and references, including patent applications and publications, are incorporated by reference for all purposes. The omission in the following claims of any aspect of subject matter that is disclosed herein is not a disclaimer of such subject matter, nor should it be regarded that the inventors did not consider such subject matter to be part of the disclosed inventive subject matter.

ELEMENT LIST

2 Vehicle
4 Direction of Motion
10 Light System
12 Light Source
12A Light 1
12B Light 2
12C Light 3
12D Light 4
14 Reflector
14A 1st
14B 2nd
14C 3rd
14D 4th
16A 1st region
16B 2nd region
18A Upper Region
18B Lower Region
20 Reflector Facet
26 Lens
28 Housing
30 Vertical dividing line
32 Horizontal dividing line
40 Light
50 Isocandela
52 Partial Isocandela
54 Cut-Off
56 Hot Spot

I claim:

1. A light system comprising:

a. a plurality of light sources;

b. a plurality of reflectors that are each aligned with and reflect one or more of the plurality of light sources in a first direction away from a vehicle that houses the light system, wherein at least one of the plurality of reflectors comprises:

i. a plurality of reflector facets;

ii. a vertical dividing line that extends through a central reflector facet; and iii. an equal number of the plurality of reflector facets in a first region on a first side of the vertical dividing line and second region on a second side of the vertical dividing line;

wherein the second region has a width from a second terminal edge of the plurality of reflectors to the vertical dividing line that is less than a width of the first region from a first terminal edge of the plurality of reflectors to the vertical dividing line; and wherein the first terminal edge and the second terminal edge are terminal edges of each the plurality of reflectors.

2. The light system of claim 1, wherein the width of some of the reflector facets in the first region, the second region, or both located adjacent to the central reflector facet are equal.

3. The light system of claim 1, wherein the width of all of the reflector facets in the first region, the second region, or both located adjacent to the central reflector facet are equal.

4. The light system of claim 1, wherein the width of all of the reflector facets in the first region, the second region, or both are different.

5. The light system of claim 1, wherein the at least one of the plurality of reflectors comprises:

a. an upper region comprising some of the plurality of reflector facets, the plurality of reflector facets each having a width and b. a lower region comprising some of the plurality of reflector facets, the plurality of reflector facets each having a width; and wherein each of the reflector facets of the upper region have a mirror reflector facet in the lower region and the width of the mirror reflector facet in the upper region is equal to the width of the mirror reflector facet in the lower region.

6. The light system of claim 5, wherein the plurality of reflector facets in the upper region, the lower region, or both extend a full vertical length of the upper region or the lower region.

7. The light system of claim 1, wherein the plurality of reflector facets reflect light from the light source and the light has a cut-off where a light intensity beyond the cut-off is about 5 lux or less at a distance of 50 m or more.

8. The light system of claim 7, wherein the distance is 70 m or more.

9. The light system of claim 7, wherein the distance is 100 m or more.

10. The light system of claim 1, wherein the plurality of reflector facets of one of the plurality of reflectors reflect light to a predetermined region and the reflected light has a cut-off formed by three of the plurality of reflector facets or less.

11. A light system comprising:

a. a plurality of light sources;

b. a plurality of reflectors that are each aligned with and reflect light from one or more of the plurality of light sources in a first direction away from a vehicle that houses the light system, wherein at least one of the plurality of reflectors comprises:

i. a plurality of reflector facets forming an upper region and a lower region;

ii. a vertical dividing line that extends through a center of one the at least one of the plurality of reflectors;

iii. a first region extending from a first side of the vertical dividing line to a first terminal edge in the upper region; and iv. a second region extending from a second side of the vertical dividing line to a second terminal edge that is located opposite the first edge in the upper region; and wherein the second region in the upper region has a width when measured from the second terminal edge to the vertical dividing line that is less than a width of the first region in the upper region when measured from the first terminal edge to the vertical dividing line, and wherein the first terminal edge and the second terminal edge are also terminal edges of each of the plurality of reflectors.

12. The light system of claim 11, wherein some or all of the plurality of reflector facets in the first region, some or all of the plurality of reflector facets in the second region, or both, located adjacent to the at least one of the plurality of reflectors including the vertical dividing line, have a width that is different from one another.

13. The light system of claim 11, wherein the dividing line extends through a center of one or more of the reflector facets and extends through a location other than a center of a row the plurality of reflectors.

14. The light system of claim 11, wherein some of the plurality of reflector facets of a reflector redirect the light from one of the plurality of light sources away from the vehicle to a first region and the redirected light has a cut-off.

15. The light system of claim 14, wherein the cut-off is formed by three of the plurality of reflector facets or less.

16. The light system of claim 14, wherein a light intensity beyond the cut-off is about 5 lux or less at a distance of 50 m or more.

17. The light system of claim 16, wherein the distance is 100 m or more.

18. The light system of claim 14, wherein the redirected light forming the cut-off is redirected from one or more reflector facets located in both the second region and the lower region.

19. The light system of claim 11, wherein the upper region has a length and the lower region has a length and the length of the lower region is greater than the length of the upper region.

20. The light system of claim 11, wherein a width of all of the reflector facets in the first region, the second region, or both, located adjacent to the at least one of the plurality of reflectors including the vertical dividing line, are different.

* * * * *